US006888298B2

(12) United States Patent
Harberts et al.

(10) Patent No.: US 6,888,298 B2
(45) Date of Patent: May 3, 2005

(54) CATHODE RAY TUBE WITH CONVERGENCE UNIT

(75) Inventors: Dirk Willem Harberts, Eindhoven (NL); Leopold Cyrille Maria Beirens, Eindhoven (NL); Antonius Henricus Van Tiel, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 396 days.

(21) Appl. No.: 10/056,369

(22) Filed: Jan. 17, 2002

(65) Prior Publication Data

US 2002/0096987 A1 Jul. 25, 2002

(30) Foreign Application Priority Data

Jan. 25, 2001 (EP) ..... 01200298

(51) Int. Cl.[7] ..... H01J 29/51

(52) U.S. Cl. ..... 313/412; 313/421; 313/428

(58) Field of Search ..... 313/412, 421, 313/428, 440, 443, 420, 413

(56) References Cited

U.S. PATENT DOCUMENTS 6,552,484 B1 * 4/2003 Dasgupta ..... 313/440

FOREIGN PATENT DOCUMENTS

| | | | |
|---|---|---|---|
| JP | 6109952 | 5/1986 | ..... H01J/29/76 |
| WO | WO9934392 | 7/1999 | ..... H01J/29/70 |
| WO | WO9966526 | 12/1999 | ..... H01J/29/70 |
| WO | WO0079560 | 12/2000 | ..... H01J/29/70 |

* cited by examiner

*Primary Examiner*—Vip Patel
*Assistant Examiner*—Mariceli Santiago

(57) ABSTRACT

The invention relates to a color display device comprising an electron gun (5) for generating three electron beams (6,7,8), and convergence means (14) for dynamically influencing the convergence of the electron beams. The convergence means (14) comprise coils (22) for generating a magnetic field. The coils (22) are provided with an electrically conducting layer.

6 Claims, 2 Drawing Sheets

CATHODE RAY TUBE WITH CONVERGENCE UNIT

Figure 1:
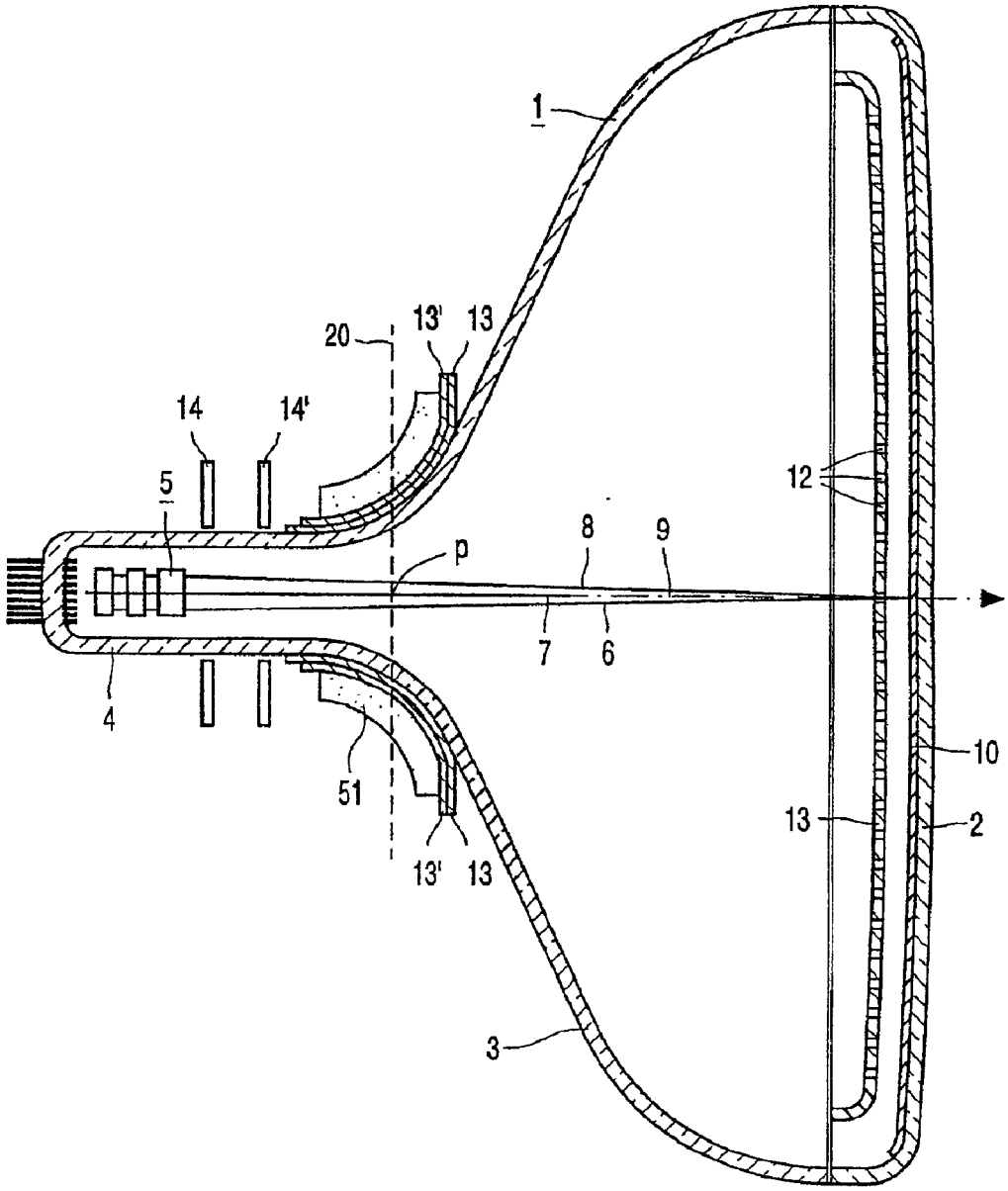

The invention relates to a cathode ray tube comprising an electron gun for generating three electron beams, deflecting means for deflecting the electron beams in a deflection plane, and convergence means for dynamically influencing a convergence of the electron beams, said convergence means comprising coils for generating a magnetic field. The invention also relates to convergence means.

WO-00/79560 discloses a color display device comprising an in-line electron gun for generating three electron beams, deflecting means for deflecting the electron beams in a deflection plane, and convergence means for dynamically influencing a convergence of the electron beams. The convergence means comprise a ring-shaped element having four coils, i.e. a quadrupole coil, for generating a magnetic quadrupole field. This magnetic quadrupole field reduces a distance between the electron beams in the deflection plane, and hence deflects the outer two electron beams towards each other. A second magnetic quadrupole coil generated by a second quadrupole coil serves to subsequently deflect the outer beams in the opposite direction. The quadrupole coils are positioned at some distance from each other. The first quadrupole coil is positioned near the electron gun and is called the gun quadrupole coil, whereas the second quadrupole coil is positioned near the deflection means.

The distance between the electron beams is dynamically influenced. By virtue thereof, the distance between the electron beams in the plane of deflection can be changed dynamically in such a manner that this distance decreases as the deflection increases. By dynamically changing this distance, as a function of the deflection, the distance between a display screen and a color selection electrode can increase accordingly in the relevant direction. The shape of an inner surface of the display screen and the distance between the display window and the color selection electrode determine the shape, in particular the curvature, of the color selection electrode. Thus, the curvature of the color selection electrode can be increased, which has a positive effect on the mechanical properties of the color selection electrode such as doming and microphonics. This method makes it possible to provide a display screen having a real flat screen surface on the outer side, while the inner surface of the display screen can be provided with a certain curvature. Such a screen has good mechanical and optical properties.

It appears that, during operation of such a display device, vertical pairs of light/dark lines occur on the screen after dark/light transitions in the image. Such lines disturb the image displayed on the screen and are unwanted.

It is an object of the invention to reduce the image disturbance caused by the light/dark pairs of lines. To this end, the invention is characterized in that the coils are provided with an electrically conducting layer. The dependent claim defines advantageous embodiments.

The invention is based on the recognition that the disturbing pairs of lines are caused by ringing. Ringing occurs if a first coil is influenced by the magnetic field of a second coil, which is positioned near the first coil. During operation of the display device, this unwanted interference phenomenon is visible as pairs of light/dark lines on the display screen. It appears that the first quadrupole coil is influenced by a Scan Velocity Modulation (SVM) coil, which is located in the neighborhood of the first quadrupole coil. The SVM coil serves to modulate the scan velocity of the electron beams by virtue of which image artifacts are suppressed.

The SVM coil can be embodied as a foil coil or as windings of copper on a plastic carrier, which is placed in a hollow cylindrical coil holder of the first quadrupole coil. High-frequency (0.5–5 MHz) signals from the SVM coil can capacitively or inductively influence the first quadrupole coil, with the above-mentioned pairs of light/dark lines as a result in which the ringing modulation is clearly visible.

It is known from WO-99/66526 that ringing may occur between the deflection coils in the case of a pair of line and frame deflection coils of a cathode ray tube, which ringing is visible as a gradually decaying curtain of alternating lighter and darker vertical bars at one of the edges of the display screen. In this case, ringing can be suppressed by winding the deflection coils from electrically conducting wire of which an outer layer, referred to as adhesive layer, has been provided with conducting particles. During the formation of the line deflection coils, the adhesive layers are melted together and a conducting layer is formed in and on the line deflection coils. Alternatively, the conductive particles can be applied by impregnating the coils with a solution of conductive material and, subsequently, allowing the solution to dry. The anti-ringing solution, in which use is made of electrically conducting wire with particles in the adhesive layer, cannot be applied because the material of the coil holder does not withstand the required high temperatures of the melting process. The solution in which the coil is impregnated has the drawback that it requires additional impregnating, cleaning and drying steps.

In an embodiment of the quadrupole coil according to the invention, electrically conducting wire is applied having an outer layer comprising conductive particles on top of the standard insulating layer. Hence the electrically conducting wire does not have an adhesive layer. The conductive particles may advantageously comprise particles of carbon.

These and other objects of the invention are apparent from and will be elucidated with reference to the embodiments described hereinafter.

Figure 2:
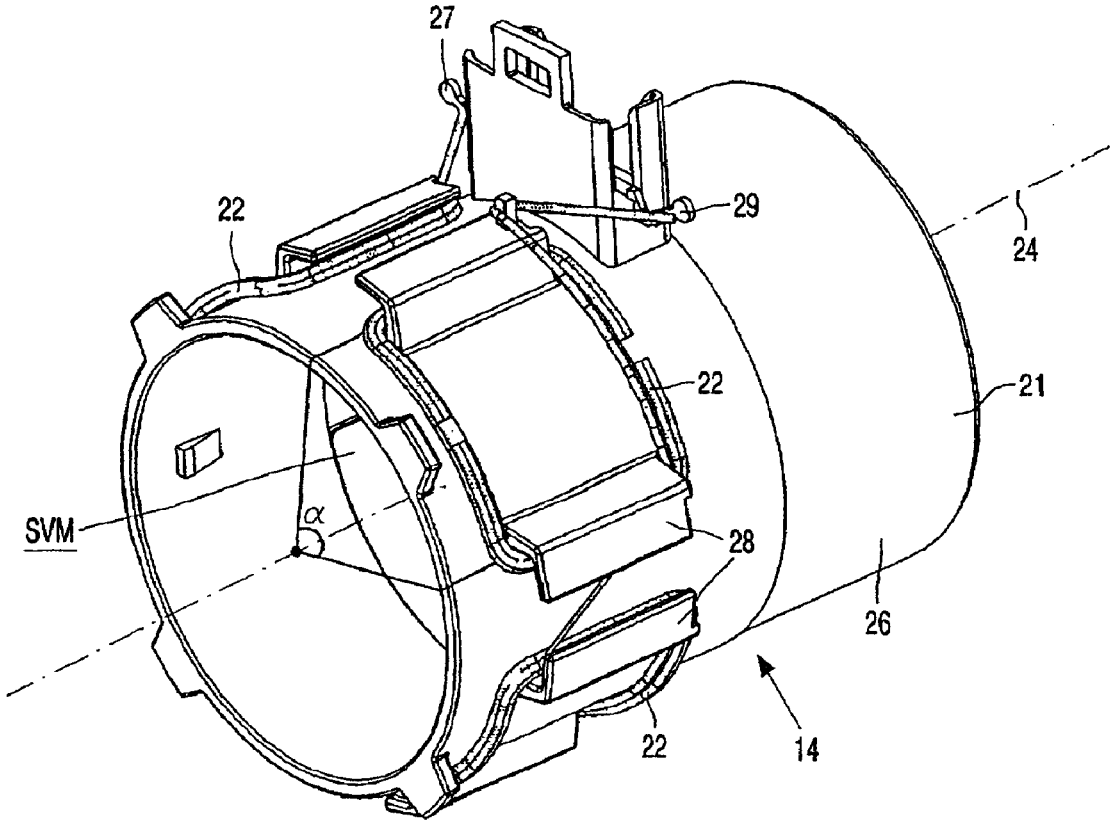

In the drawings:

FIG. 1 is a sectional view of a display device, in which the invention is schematically shown; and FIG. 2 shows an embodiment of the convergence means according to the invention.

The Figures are not drawn to scale. In the Figures, like reference numerals generally refer to like parts.

The display device shown in FIG. 1 comprises a cathode ray tube, in this example a color display tube, having an evacuated envelope 1 which includes a display window 2, a cone portion 3 and a neck 4. The neck 4 accomodates an in-line electron gun 5 for generating three electron beams 6, 7 and 8 which extend in one plane, the in-line plane, which in this case is the plane of the drawing. In the undeflected state, the central electron beam 7 substantially coincides with the tube axis 9.

The inner surface of the display window is provided with a display screen 10. The display screen 10 comprises a large number of phosphor elements luminescing in red, green and blue. On their way to the display screen, the electron beams are deflected across the display screen by way of an electromagnetic deflection unit 51 and pass through a color selection electrode 11 which is arranged in front of the display window 2 and comprises a thin plate having apertures 12. The three electron beams 6, 7 and 8 pass through the apertures 12 of the color selection electrode at a small angle relative to each other, and hence each electron beam impinges only on phosphor elements of one color. In addition to a coil holder 13, the deflection unit 51 comprises deflection coils 13' for deflecting the electron beams in two mutually perpendicular directions. The display device further includes means for generating voltages, which during operation are fed to components of the electron gun via feedthroughs. The deflection plane 20 is schematically indicated as well as the distance p between the electron beams 6 and 8 in this plane.

The color display device comprises two convergence units 14, 14', with a first unit 14 being used, in operation, to dynamically bend, i.e. as a function of the deflection in a direction, the outermost electron beams towards each other, and a second unit 14' serving to dynamically bend the outermost electron beams in opposite directions.

The two convergence units 14, 14' are positioned at some distance from each other, and are used to vary the distance p, as a function of the deflection, in a such a manner that the distance p decreases as a function of the deflection in at least one direction. The first unit 14 is positioned close to the gun and will be referred to as the "gun quadrupole", whereas the second unit 14' is located near the deflection unit.

FIG. 2 shows an embodiment of the gun quadrupole 14, which comprises a cylindrically shaped element 21 having an outer surface 26 provided with protrusions 28 around which four coils 22 are wound in respective stacks of wire. Pins 27 and 29 are a starting position and an end position, respectively, of the coil winding process and are also used as connection pins to the outer electronics. The gun quadrupole 14 thus obtained comprises four identical coils 22, where each coil 22 is located in a quadrant of the circle and symmetrically arranged with respect to a line that has an angle of 45° with respect to the X-direction. This embodiment has the advantage that a quadrupole element is created, which-during operation-is almost free of dipole, 6-pole or 8-pole magnetic field components.

Moreover, the angle a has been chosen to be such that each coil 22 extends through an angle alpha having a value of 60°±5°. Here the angle $\alpha$ is measured from the middle of the stack of wires. This measurement ensures the absence of 12-pole field components.

The cylindrical shape of the element 21 facilitates easy positioning of the quadrupole in the neighborhood of the electron gun. A further advantage is that the cylinder may be used to contain additional coil elements such as, for example, a Scan Velocity Modulator (SVM) coil. The SVM coil serves to modulate the scan velocity of the electron beams by virtue of which image artifacts are suppressed. This additional coil may be contained in the form of a wound-up foil in the cylinder.

In summary, the invention relates to a color display device comprising an inline electron gun 5 for generating three electron beams 6,7,8, and convergence means 14 for dynamically influencing the convergence of the electron beams. The convergence means 14 comprise coils 22 for generating a magnetic field. The coils 22 are provided with an electrically conducting layer for the suppression of ringing.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

What is claimed is:

1. A cathode ray tube comprising an electron gun for generating three electron beams;

deflecting means for deflecting the electron beams; in a deflection plane; and convergence means for dynamically influencing a convergence of the electron beams, said convergence means comprising coils for generating a magnetic field wherein the coils are provided with an electrically conductive layer.

2. Convergence means for dynamically influencing a convergence of electron beams, said convergence means comprising coils for generating a magnetic field wherein the coils are provided with an electrically conductive layer.

3. A display device comprising:

a cathode ray tube having a display screen, a cone portion, and a neck that holds an electron gun for emitting three electron beams toward said display screen;

deflection coils around said cone portion for deflecting said electron beams; and convergence coils disposed between said electron gun and said deflection coils, said convergence coils for dynamically influencing a convergence of said electron beams using a magnetic field, wherein said convergence coils have an electrically conductive layer.

4. The display device of claim 3, further including a scan velocity modulator coil disposed between said electron beams and said convergence coils.

5. The display device of claim 4 wherein said convergence coils form a quadrupole of symmetrically arranged convergence coils.

6. The display device of claim 5 wherein said convergence coils and said scan velocity modulator coil are mounted on a cylindrically shaped element that mounts on said neck.

* * * * *